US006976870B1

(12) United States Patent
Li

(10) Patent No.: US 6,976,870 B1
(45) Date of Patent: Dec. 20, 2005

(54) CONNECTOR ASSEMBLY

(76) Inventor: Chun-De Li, 2F., No. 5, Alley 3, Lane 147, Pateh Rd., Sec. 2, Panchiao City, Taipei Hsien (TW)

( * ) Notice: Subject to any disclaimer, the term of this patent is extended or adjusted under 35 U.S.C. 154(b) by 0 days.

(21) Appl. No.: 11/078,348

(22) Filed: Mar. 14, 2005

(30) Foreign Application Priority Data

Jul. 8, 2004 (TW) ..... 93210779 U

(51) Int. Cl.[7] ..... H01R 13/648
(52) U.S. Cl. ..... 439/541.5; 439/607
(58) Field of Search ..... 439/541.5, 939, 439/79, 680, 701, 540.1, 607–610

(56) References Cited

U.S. PATENT DOCUMENTS 6,083,044 A * 7/2000 Wang et al. ..... 439/567
6,234,833 B1 * 5/2001 Tsai et al. ..... 439/541.5
6,250,958 B1 * 6/2001 Hsish ..... 439/541.5
6,688,913 B2 * 2/2004 Li ..... 439/541.5
6,837,742 B1 * 1/2005 Chou et al. ..... 439/541.5
6,910,917 B2 * 6/2005 Chen ..... 439/541.5

* cited by examiner

*Primary Examiner*—Gary Paumen
*Assistant Examiner*—Edwin A. Leon
(74) *Attorney, Agent, or Firm*—Bacon & Thomas PLLC

(57) ABSTRACT

A connector assembly includes a frame having at least two installing sections, each installing section having a connector, a shelter panel disposed around each connector, at least one embedding latch disposed on both sides of an end of the shielded panel facing the frame and at least one embedding hook disposed on both sides of another end, an embedding groove disposed on the installing section at the position corresponding to the embedded latches, and another embedding groove disposed at the position corresponding to the embedded hook, such that when the connectors are installed to the installing sections, the embedding latch are embedded into the embedding grooves and the embedding hooks are embedded into another embedding grooves respectively so as to secure the connectors onto the frame.

7 Claims, 3 Drawing Sheets

CONNECTOR ASSEMBLY

FIELD OF THE INVENTION

The present invention generally relates to connectors, and more particularly to a connector assembly that can lower its production cost and improve the convenience of its assembling.

BACKGROUND OF THE INVENTION

Referring to FIG. 1, a conventional connector assembly is illustrated. The connector assembly comprises a base 1, an accommodating space 10 disposed on a side of the base 1, at least one first latch member 12 installed in the accommodating space 10, at least one port 2, a ground terminal 20 disposed at a distal end of the port 2, a second latch member 22 disposed on another distal end, and a protruded end 24 disposed on a side of the port 2, such that when the connector is assembled, the second latch member 22 on the port 2 is embedded into the first latch member 12 of the base 1, and then the base 1 is installed onto a main board (not shown in the figure), and an electronic device is connected through the protruded end 24 on the port 2 for transmitting signals.

To prevent electromagnetic interference, a metal panel 3 is installed on a surface with the installed port 2 and the back of the surface faces the base 1. The metal panel 3 has a connecting plate 30 disposed on both sides of the metal panel 3 separately and an opening 32 disposed at a position corresponding to the protruded end 24 of the port 2, and a groove 25 disposed on the base 1 at a position corresponding to the connecting plate 30. When the connecting plate 30 is embedded into the groove 25, the metal panel 3 can be fixed onto the base 1 and the protruded end 24 of the port 2 is exposed from the metal panel 3.

However, if the quantity of ports 2 on the base 1 is increased or decreased, then it is necessary to build new molds to produce another base and build another new metal panel to fit the installation positions of the ports 2, and thus will greatly increase the cost.

Further, if the quantity of ports 2 disposed on the new base is large, then the new metal panel has to vary according to the length of the new base to fit the new base, and more openings 32 are needed on the new metal panel, so that the protruded ends 24 of the ports 2 can be exposed to the outside. Since the metal panel is a thin metal sheet, the strength of the structure will be weakened if there are too many holes (openings) on the metal panel. If the length of the metal panel is too long, the strength of the structure will be insufficient to hold the panel, and the new metal panel will be bent or deformed easily.

Since the new metal panel may be damaged easily by the collision resulted in its transportation and cannot be used anymore before its installation, therefore it will cause a waste of components and an increase of production cost. Furthermore, there are too many openings 32 to correspond to the protruded ends 24 of the ports 2, and thus the new metal panel usually cannot be inserted into the base 1 at the first time, which makes the assembly more difficult and increases the assembling time and lower production efficiency. Thus, it is necessary to develop a metal panel with sufficient structural strength and a minimum cost of developing the molds as well as a connector assembly convenient to be assembled.

SUMMARY OF THE INVENTION

In view of the shortcomings of the prior-art connector assembly causing a waste of components, increasing the production cost and assembling time, and lowering the production efficiency, the inventor of the present invention focused on finding feasible solutions and conducted extensive research and experiment to overcome the shortcomings of the prior arts and finally invented a connector assembly.

It is therefore a primary objective of the present invention to provide a connector assembly that can lower the production cost and improve the convenience of assembling.

To achieve the foregoing objective, the connector assembly comprises: a frame having at least two installing sections, each installing section installing a connector; a shelter panel disposed around each connector; at least one embedding latch disposed on both sides of an end of the shielded panel facing the frame and at least one embedding hook disposed on both sides of another end; an embedding groove disposed on the installing section at the position corresponding to the embedded latches; and another embedding groove disposed at the position corresponding to the embedded hook. Therefore, when the connectors are installed to the installing sections, the embedding latch are embedded into the embedding grooves, and the embedding hooks are embedded into another embedding grooves respectively so as to secure the connectors onto the frame.

The above and other objects, features and advantages of the present invention will become apparent from the following detailed description taken with the accompanying drawings.

DETAILED DESCRIPTION OF THE PREFERRED EMBODIMENTS

Figure 1:
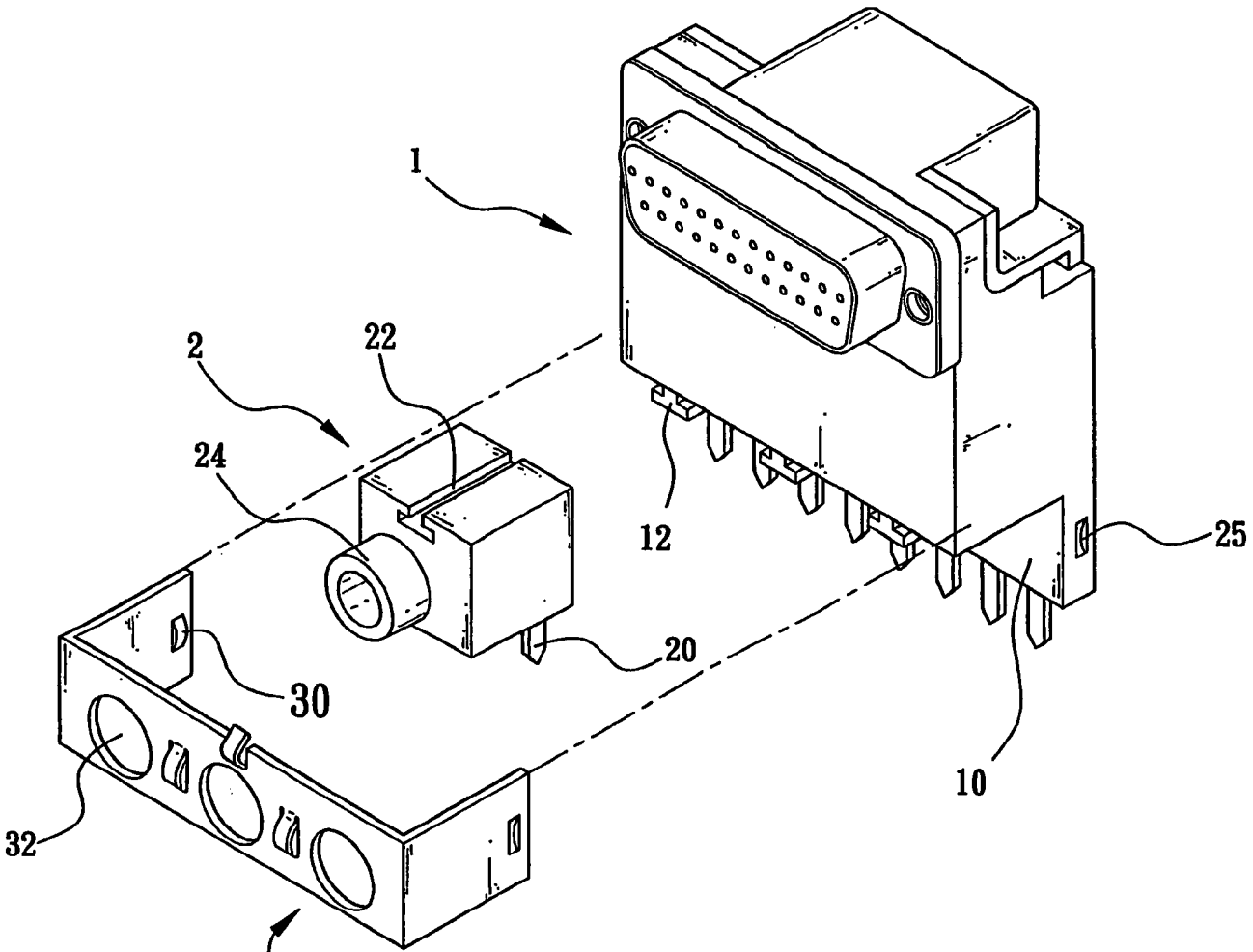
FIG. 1 (Prior Art)
FIG. 1 is an assembly view of a connector assembly of a prior art.
Figure 2:
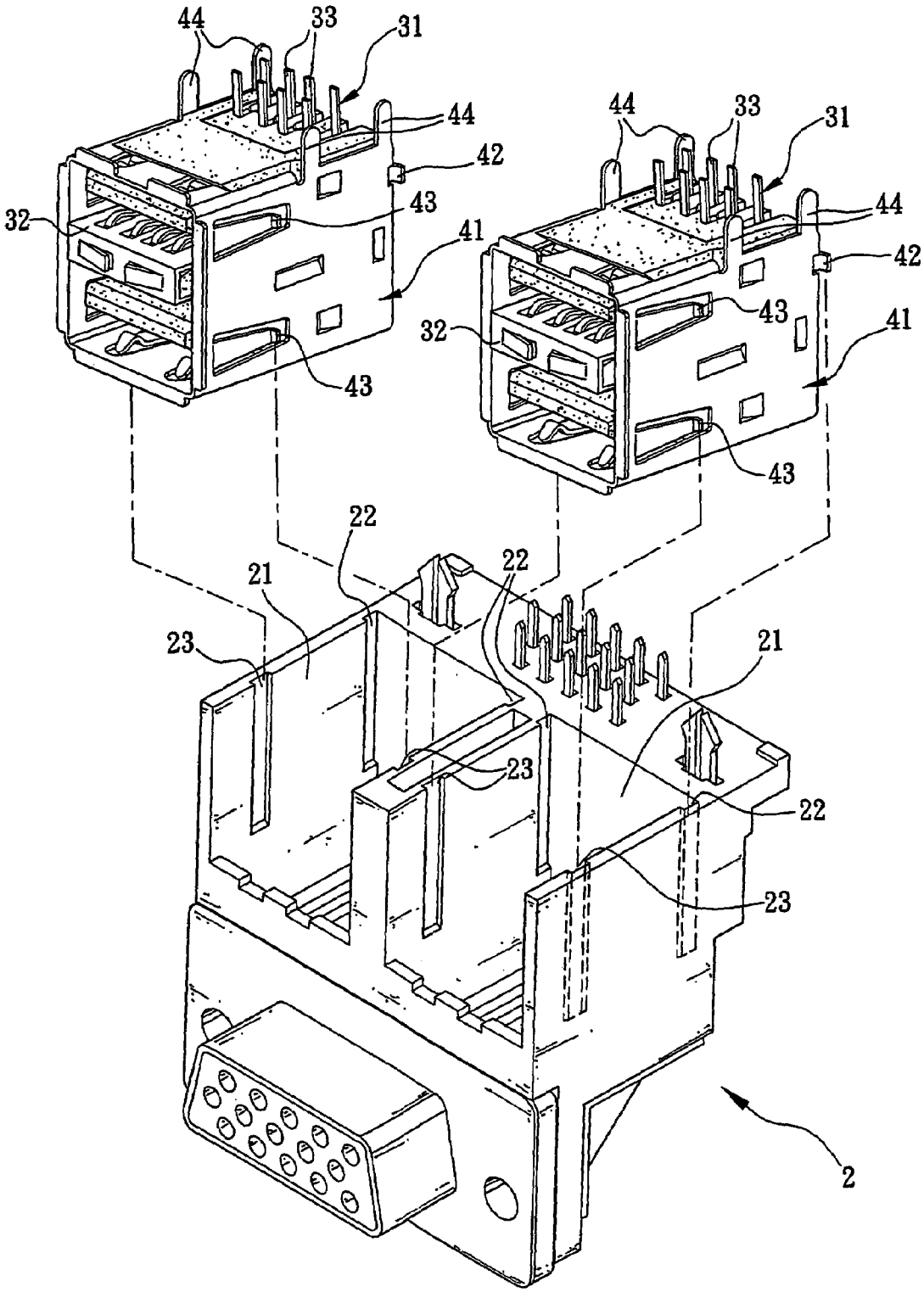
FIG. 2 is an assembly view of a connector assembly of the invention.

Referring to FIG. 2, a connector assembly in accordance with the present invention is illustrated. The connector assembly comprises: a frame 2, having at least two installing sections 21, said each installing section 21 installing a connector 31; at least one connector 31, each comprising an inserting section 32 disposed at a front end, a plurality of terminals 33 disposed on a side of a bottom, and an electromagnetic shielded panel 41 disposed on a surface of each connector 31, and the terminals 33 and inserting sections 32 of the connector 31 are exposed out of the shielded panel 41, such that the terminals 33 are connected to a circuit board of an electronic device, and the inserting section 32 is connected to another corresponding connector, and the shielded panel 41 includes at least one embedding latch 42 on both ends of the shielded panel 41 facing an end of the frame 2 and at least one embedding hook 43 on both sides of another end, and the installing section 21 includes an embedding groove 22 disposed on the installing section 21 at a position corresponding to the embedding latch 42 and another embedding groove 23 disposed at a position corresponding to the embedding hook 43.

Referring to FIG. 2, when the connectors 31 are installed in the installing sections 21, the embedding latches 42 are coupled to the embedded grooves 22 respectively and the embedding hooks 43 are embedded into another embedding groove 23 respective to secure the connectors 31 onto the frame 2. The connector assembly installed on other installing section of the frame 2 is a prior art, and thus will not be described here.

Referring to FIG. 2 again, the installing section 21 is a frame having an accommodating space slightly larger than the connector 31, and the embedded grooves 22 and another embedded grooves 23 are longitudinal sliding grooves respectively disposed on both sides of the frame, such that the embedding latches 42 and the embedding hooks 43 slide on the embedding grooves 22 and another embedding grooves 23 and then are embedded so as to install and secure the connectors 31 into the installing sections 21 from the bottom of the installing sections 21.

Referring to FIG. 2 again, the shielded panel 41 includes a plurality of fixed pins 44 disposed at appropriate positions corresponding to a side of the terminals 33, so that when the connectors 31 are connected to predetermined installing positions of a circuit board, the fixed pins 44 can be connected onto the circuit board at corresponding predetermined positions to fix the connector 31 onto the circuit board by the fixed pins 44.

Figure 3:
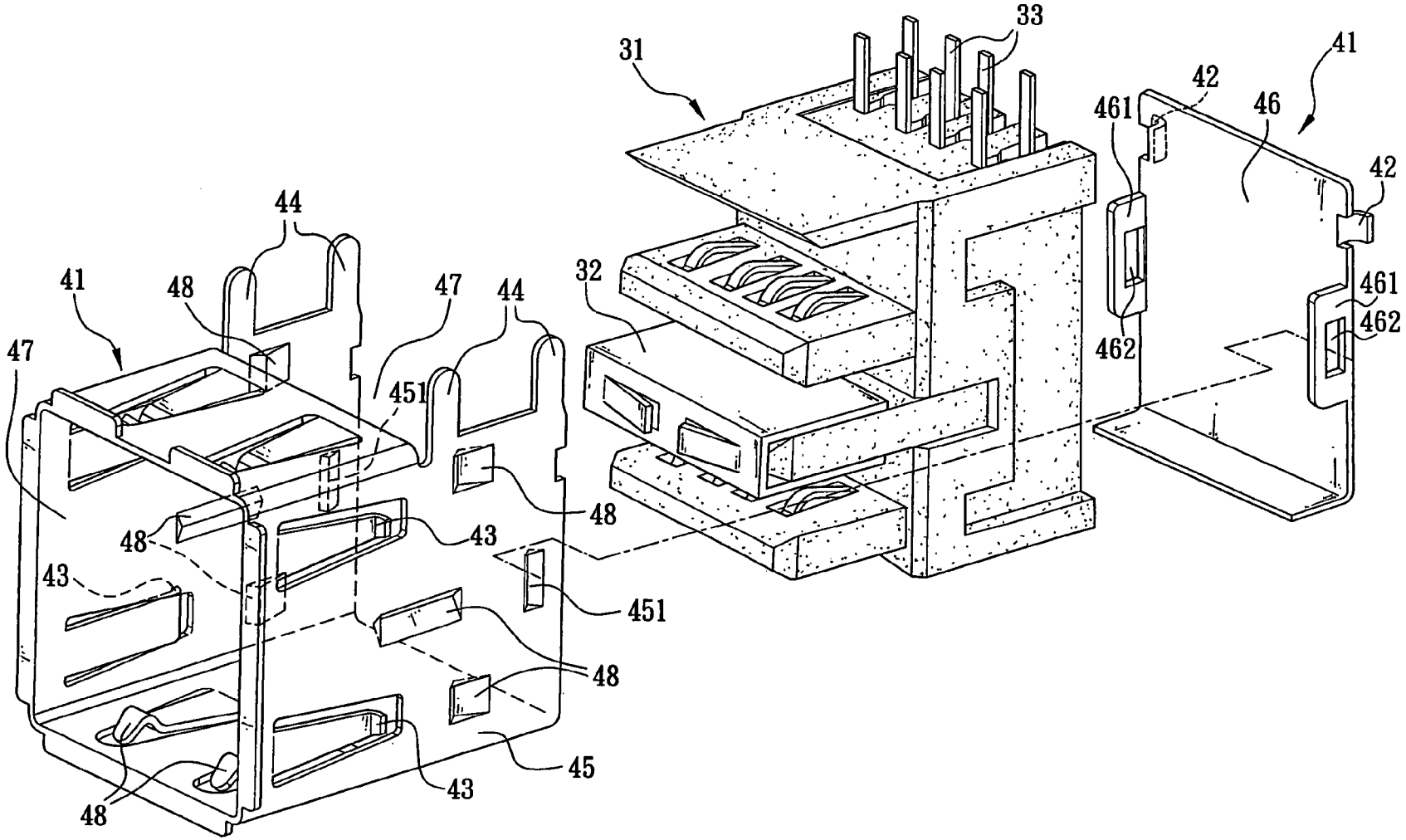
FIG. 3 an assembly view of a connector and a panel of the invention.

Referring to FIG. 3, the shielded panel 41 is installed on a surface of the connector 31 and the shielded panel 41 has a front casing 45 and a rear casing 46, and the front casing 45 has an opening 47 separately disposed at a front end and a bottom, such that the terminal 33 and the inserting section 32 of the connector 31 are exposed from the opening 47 out of the shielded panel 41, and the front casing 45 includes at least one inwardly protruded latch 48 disposed on both sides and a top surface of the front casing 45, and the rear casing 46 is installed at an open groove at a rear side of the front casing 45, and the rear casing 46 includes an installing section 461 perpendicularly disposed on both sides and each installing section 461 includes a latch piece 462, and the front casing 45 includes another latch piece 451 disposed on a corresponding position of the latch piece 462.

Referring to FIG. 3, when the shielded panel 41 is installed on a surface of the connector 31, the front casing 45 is installed on a surface at a front end of the connector 31, so that the latches 48 are latched on both sides and a top side of the connector 31 and the front casing 45 is fixed onto a surface at a front end of the connector 31, and then the rear casing 46 is installed at an open groove at a rear end of the front casing 45 to latch the latch piece 462 to another latch piece 451 to fix the rear casing 46 to a rear end of the connector 31.

Referring to FIG. 2, the connector 31 is a shielded double mini DIN, a USB B serial female socket, or a USB 1394 Jack.

In view of the description above, the connector 31 includes a shielded panel 41, such that the quantity of holes disposed on the shielded panel 41 is decreased drastically, and the quantity of related components installed on the frame 2 is decreased, and thus the components can be installed onto the frame 2 one by one quickly. Regardless of increasing or decreasing the quantity of connectors on the installing section 21 of the frame 2, it only needs to produce one frame 2 that meets the requirements, and then installs the connectors 31. The present invention makes the assembling simple and convenient, greatly reduces the assembling time, saves the cost for developing the mold of the shielded panel 41, and provides a structure with sufficient strength to the shielded panel 41.

While the invention herein disclosed has been described by means of specific embodiments, numerous modifications and variations could be made thereto by those skilled in the art without departing from the scope and spirit of the invention set forth in the claims.

What is claimed is:

1. A connector assembly, comprising:

a frame, having at least two installing sections, said each installing section installing a connector;

at least one connector, said each connector comprising an inserting section disposed at a front end, a plurality of terminals disposed on a side of a bottom, and a shielded panel disposed on a surface of said each connector, and said terminals and inserting sections of said connector are exposed out of said shielded panel, such that said terminals are connected to a circuit board of an electronic device, and said inserting section is connected to another corresponding connector, and said shielded panel includes at least one embedding latch on both ends of said shielded panel facing an end of said frame and at least one embedding hook on both sides of another end, and said installing section includes an embedding groove disposed on said installing section at a position corresponding to said embedding latch and another embedding groove disposed at a position corresponding to said embedding hook;

thereby, when said connectors are installed in said installing sections, said embedding latches are coupled to said embedded grooves respectively and said embedding hooks are embedded into another embedding groove respective to secure said connectors onto said frame.

2. The connector assembly of claim 1, wherein said installing section is a frame having an accommodating space slightly larger than said connector, and said embedded grooves and said another embedded grooves are longitudinal sliding grooves respectively disposed on both sides of said frame, such that said embedding latches and said embedding hooks slide on said embedding grooves and said another embedding grooves and then are embedded so as to install and secure said connectors into said installing sections from the bottom of said installing sections.

3. The connector assembly of claim 1, wherein said shielded panel includes a plurality of fixed pins disposed at appropriate positions corresponding to a side of said terminals, so that when said connectors are connected to predetermined installing positions of a circuit board, said fixed pins can be connected onto said circuit board at corresponding predetermined positions to fix said connector onto said circuit board by said fixed pins.

4. The connector assembly of claim 1, wherein said shielded panel is installed on a surface of said connector and said shielded panel has a front casing and a rear casing, and said front casing has an opening separately disposed at a front end and a bottom, such that said terminal and said inserting section of said connector are exposed from said opening out of said shielded panel, and said front casing includes at least one inwardly protruded latch disposed on both sides and a top surface of said front casing, and said rear casing is installed at an open groove at a rear of said front casing, and said rear casing includes an installing section perpendicularly disposed on both sides and each installing section includes a latch piece, and said front casing includes another latch piece disposed on a corresponding position of said latch piece;

thereby, when said shielded panel is installed on a surface of said connector, said front casing is installed on a surface at a front end of said connector, so that said latches are latched on both sides and a top side of said connector and said front casing is fixed onto a surface at a front end of said connector, and then said rear casing is installed at an open groove at a rear end of said front casing to latch said latch piece to said another latch piece to fix said rear casing to a rear end of said connector.

5. The connector assembly of claim 1, wherein said connector is a shielded double mini DIN.

6. The connector assembly of claim 1, wherein said connector is a USB B serial female socket.

7. The connector assembly of claim 1, wherein said connector is a USB 1394 jack.

* * * * *